US012342896B2

(12) United States Patent
Liu et al.

(10) Patent No.: US 12,342,896 B2
(45) Date of Patent: Jul. 1, 2025

(54) WEARABLE HEAD-PROTECTING SAFETY DEVICE

(71) Applicant: CHANGZHOU SHINE SCIENCE & TECHNOLOGY CO. LTD., Changzhou (CN)

(72) Inventors: Zhuang Liu, Changzhou (CN); Libin Liu, Changzhou (CN)

(73) Assignee: CHANGZHOU SHINE SCIENCE & TECHNOLOGY CO. LTD., Jiangsu (CN)

( * ) Notice: Subject to any disclaimer, the term of this patent is extended or adjusted under 35 U.S.C. 154(b) by 0 days.

(21) Appl. No.: 18/629,745

(22) Filed: Apr. 8, 2024

(65) Prior Publication Data

US 2025/0113891 A1 Apr. 10, 2025

Related U.S. Application Data

(63) Continuation of application No. PCT/CN2023/103532, filed on Jun. 29, 2023.

(30) Foreign Application Priority Data

Dec. 26, 2022 (CN) ..... 202211678817.5

(51) Int. Cl.
*A42B 3/22* (2006.01)
*A42B 3/28* (2006.01)

(52) U.S. Cl.
CPC ..... *A42B 3/223* (2013.01); *A42B 3/221* (2013.01); *A42B 3/222* (2013.01); *A42B 3/281* (2013.01); *A42B 3/283* (2013.01)

(58) Field of Classification Search
CPC ..... A42B 3/223; A42B 3/221; A42B 3/222; A42B 3/281; A42B 3/283
See application file for complete search history.

(56) References Cited

U.S. PATENT DOCUMENTS 4,462,119 A * 7/1984 Rudd ..... A42B 3/221 2/424
4,615,052 A * 10/1986 Nava ..... A42B 3/24 2/427

(Continued)

FOREIGN PATENT DOCUMENTS

CN 105188440 A 12/2015
CN 105919212 A 9/2016

(Continued)

*Primary Examiner* — Khaled Annis
(74) *Attorney, Agent, or Firm* — SZDC Law PC

(57) ABSTRACT

The present invention relates to the technical field of head protection equipment, in particular to a wearable head-protecting safety device, including a helmet body provided with oppositely arranged mounting seats on both sides near the lower edge thereof and a quick-release adapter assembly in form of a mask structure, wherein the quick-release adapter assembly is provided with a quick-release mechanism cooperating with the mounting seat at both ends near the upper edge thereof, the quick-release mechanism being relatively rotatable and detachably connected to the mounting seats, and wherein the quick-release adapter assembly is a grinding flip assembly or a welding flip assembly. It is possible to achieve switching of various types of masks through the quick-release adapter assembly detachably connected to the helmet body. Compared with prior art, the present invention can be applied to various scenarios through mask switching, improving the applicability of the wearable head-protecting safety device.

9 Claims, 9 Drawing Sheets

(56) References Cited

U.S. PATENT DOCUMENTS 4,621,377 A * 11/1986 Pennell ..... A42B 3/223 2/10
4,689,836 A * 9/1987 Vitaloni ..... A42B 3/222 2/9
5,005,221 A * 4/1991 Chen ..... A42B 3/222 2/424
5,091,997 A * 3/1992 Foehl ..... A42B 3/222 2/424
5,165,117 A * 11/1992 Kamata ..... A42B 3/223 2/424
5,177,817 A * 1/1993 Kamata ..... A42B 3/222 2/424
5,182,816 A * 2/1993 Arai ..... A42B 3/222 2/424
5,329,642 A * 7/1994 Dampney ..... A42B 3/222 2/424
5,333,329 A * 8/1994 Hong ..... A42B 3/222 2/424
6,212,689 B1 * 4/2001 Lee ..... A42B 3/326 2/424
6,260,213 B1 * 7/2001 Eom ..... A42B 3/222 2/424
8,813,269 B2 * 8/2014 Bologna ..... A63B 71/081 2/6.2
2003/0088907 A1 * 5/2003 Gafforio ..... A42B 3/222 2/424
2004/0049830 A1 * 3/2004 Gafforio ..... A42B 3/222 2/171
2004/0187195 A1 * 9/2004 Wang Lee ..... A42B 3/281 2/410
2005/0273912 A1 * 12/2005 Gafforio ..... A42B 3/226 2/424
2006/0080761 A1 * 4/2006 Huh ..... A61F 9/06 2/10
2006/0101561 A1 * 5/2006 Kuo ..... A42B 3/222 2/424
2007/0113318 A1 * 5/2007 Weston ..... A42B 3/281 2/171.3
2007/0124851 A1 * 6/2007 Pyo ..... A42B 3/222 2/424
2010/0224194 A1 * 9/2010 Walker ..... A62B 18/02 128/205.24
2010/0287676 A1 * 11/2010 Seo ..... A61F 9/064 2/8.2
2011/0072563 A1 * 3/2011 Choi ..... A42B 3/24 403/349
2011/0094019 A1 * 4/2011 Isobe ..... A42B 3/222 2/424
2011/0265790 A1 * 11/2011 Walker ..... A42B 3/286 128/201.23
2011/0302701 A1 * 12/2011 Kuo ..... A42B 3/326 2/424
2012/0117718 A1 * 5/2012 Cho ..... A42B 3/223 2/424
2012/0144566 A1 * 6/2012 Hunt ..... A42B 3/223 2/424
2015/0074877 A1 * 3/2015 Huh ..... A42B 3/225 2/422
2015/0135417 A1 * 5/2015 Lebel ..... A42B 3/326 2/424
2016/0286890 A1 * 10/2016 Morin ..... A42B 3/221
2016/0331059 A1 * 11/2016 Basson ..... A42B 3/222
2016/0360821 A1 * 12/2016 Benton ..... A42B 3/226
2017/0079364 A1 * 3/2017 Paulson ..... A42B 3/222
2017/0325534 A1 * 11/2017 Noordzij ..... A42B 3/223
2018/0213877 A1 * 8/2018 Liao ..... A42B 3/225
2020/0029645 A1 * 1/2020 Salvetti ..... A42B 3/222
2020/0029646 A1 * 1/2020 Salvetti ..... A42B 3/328
2020/0037692 A1 * 2/2020 Levesque ..... A42B 3/227
2020/0113268 A1 * 4/2020 Liao ..... A42B 3/223
2021/0274877 A1 * 9/2021 Liao ..... A42B 3/205
2022/0030977 A1 * 2/2022 Huh ..... A41D 13/1184
2022/0071334 A1 * 3/2022 Huang ..... A42B 3/223
2022/0408870 A1 * 12/2022 Lee ..... A42B 3/222
2023/0255301 A1 * 8/2023 Levesque ..... A42B 3/226 2/424
2023/0292875 A1 * 9/2023 Guazzerotti ..... A42B 3/222 2/427
2023/0301388 A1 * 9/2023 Paulson ..... A42B 3/225
2024/0130460 A1 * 4/2024 Park ..... A42B 3/223
2024/0180282 A1 * 6/2024 Lee ..... A42B 3/223
2024/0423313 A1 * 12/2024 Huang ..... A42B 3/225

FOREIGN PATENT DOCUMENTS

CN 206079183 U 4/2017
CN 211323221 U 8/2020
CN 217986798 U 12/2022
CN 116114960 A 5/2023

* cited by examiner

WEARABLE HEAD-PROTECTING SAFETY DEVICE

This application is a Continuation Application of PCT/CN2023/103532, filed on Jun. 29, 2023, which claims priority to Chinese Patent Application No. CN 202211678817.5, filed on Dec. 26, 2022, which is incorporated by reference for all purposes as if fully set forth herein.

TECHNICAL FIELD

The present invention relates to the technical field of head protection equipment, in particular to a wearable head-protecting safety device.

BACKGROUND

With the development of welding and grinding industries, the requirements for the protection level of the head are becoming higher and higher, and the scenarios involved are becoming more and more complex. For example, safety helmets are needed in workshops with driving operations, welding masks are needed to protect the eyes of operators during electric welding operations, and protective masks are needed to avoid particle impact during grinding operations.

In the prior art, the Chinese utility model patent CN208405084U discloses an automatic darkening mask that allows parameter adjustment through a single knob on Jan. 22, 2019. By providing an automatic darkening filter and a knob on the mask, the filter parameters can be adjusted easily to protect the eyes of users.

The Chinese invention patent application CN112717294A discloses an air supply mechanism with upper air duct, a headgear and an electric protective equipment on Apr. 30, 2021. The air is delivered to the face area through the upper air supply mechanism, which is suitable for the working environment with poor air quality, reducing the discomfort caused by direct blowing onto the user's face and improving comfort during operation.

However, when implementing the above solutions, the inventor found that the above-mentioned headgear is only suitable for specific work scenarios, and a different headgear is needed for replacement when switching to a different work environment. If the operators need to work in multiple jobs, they need to be equipped with various types of headgear, reducing the applicability of headgear.

SUMMARY

In view of at least one of the above technical problems, the present invention provides a wearable head-protecting safety device, comprising a helmet body that cooperates with a quick-release structure to realize switching of multiple masks, thereby improving the applicability of the wearable head-protecting safety device.

According to a first aspect of the present invention, there is provided a wearable head-protecting safety device, comprising a helmet body provided with oppositely arranged mounting seats on both sides near the lower edge thereof and a quick-release adapter assembly in form of a mask structure, wherein the quick-release adapter assembly is provided with a quick-release mechanism cooperating with the mounting seat at both ends near the upper edge thereof, the quick-release mechanism being relatively rotatable and detachably connected to the mounting seats;

wherein the quick-release adapter assembly is a grinding flip assembly or a welding flip assembly.

In some embodiments of the present invention, the helmet body is provided with an air inlet at the rear end thereof, and an air guide groove extending from the air inlet to the front end thereof on top of the inner wall of the helmet.

In some embodiments of the present invention, an air supply connector is connected to the air inlet, and an air guide plate is connected to the inner wall of the helmet body, the air guide plate cooperating with the air guide groove to form an air supply channel in communication with the air supply connector.

In some embodiments of the present invention, the front end of the inner wall of the helmet body is provided with an air direction regulator in communication with the air supply channel, the air direction regulator including a plurality of air guides that are pivotally connected through links such that they can rotate relative to each other, wherein the inner wall of the air direction regulator is provided with a positioning member connected to the air guides in a clearance fit.

In some embodiments of the present invention, an end face of the mounting seat is provided with an elastically connected locking member, and the quick-release mechanism is provided with at least two locking grooves corresponding to the locking member, the locking member being configured to extend into the locking groove when the locking groove on the quick-release mechanism rotates to the position of the locking member, whereby the quick-release adapter assembly can be locked when opened and closed.

In some embodiments of the present invention, the mounting seat is provided with a mounting hole and the quick-release mechanism is provided with a connecting column cooperating with the mounting hole, the connecting column being radially provided with a telescopic stopper, wherein the distance between two ends of the stopper is greater than the diameter of the mounting hole when the stopper extends, and wherein the stopper is disposed at a position where the connecting column protrudes from the mounting hole.

In some embodiments of the present invention, the quick-release mechanism is provided with a hollow cavity having an elastic member therein, wherein the stopper is in form of a bendable plate-shaped structure and is configured to bend when subjected to external force along the depth direction of the hollow cavity, causing both ends to retract towards the center of the connecting column, and to restore deformation under the force of the elastic member when the external force disappears.

In some embodiments of the present invention, the grinding flip assembly comprises a grinding mask connected to the quick-release mechanism.

In some embodiments of the present invention, the welding flip assembly comprises a welding mask connected to the quick-release mechanism.

In some embodiments of the present invention, the wearable head-protecting safety device further comprises a lower support bracket in form of a frame structure, wherein the lower support bracket is integrated into the quick-release adapter assembly or independently connected to the helmet body in a relatively rotatable manner.

The present invention is advantageous in that the wearable head-protecting safety device of the present invention achieves the installation and replacement of quick-release adapter assembly by providing the mounting seats on the helmet body, and switching of various types of masks through the quick-release adapter assembly detachably connected to the helmet body. Compared with prior art, the present invention can be applied to various scenarios through mask switching, improving the applicability of the wearable head-protecting safety device.

DESCRIPTION OF THE DRAWINGS

In order to more clearly illustrate the embodiments of the present invention or the technical solutions in the prior art, the accompanying drawings to be used in the description of the embodiments or prior art will be briefly described below. It is obvious that the accompanying drawings in the following description are only some of the embodiments recorded in the present invention, and other accompanying drawings can be obtained according to these accompanying drawings without creative work for those of ordinary skill in the art.

DESCRIPTION OF THE EMBODIMENTS

The technical solutions in the embodiments of the present invention will be described clearly and completely in conjunction with the accompanying drawings in the embodiments of the present invention. Obviously, the described embodiments are only a portion of the embodiments of the present invention, rather than all the embodiments.

It should be noted that when an element is referred to as being "fixed to" another element, it can be directly on the another element or an intermediate element may also be present. It should be noted that when an element is referred to as being "connected to" another element, it can be directly on the another element or an intermediate element may also be present. The terms "vertical", "horizontal", "left", "right" and similar expressions used herein are for illustrative purposes only and do not mean that they are the only mode of implementation.

Unless otherwise defined, all technical and scientific terms used herein have the same meaning as commonly understood by those skilled in the art of the present invention. The terms used herein are for the purpose of describing specific embodiments only and are not intended to limit the invention. The term "and/or" as used herein includes any and all combinations of one or more of the related listed items.

Embodiment 1

Figure 1:
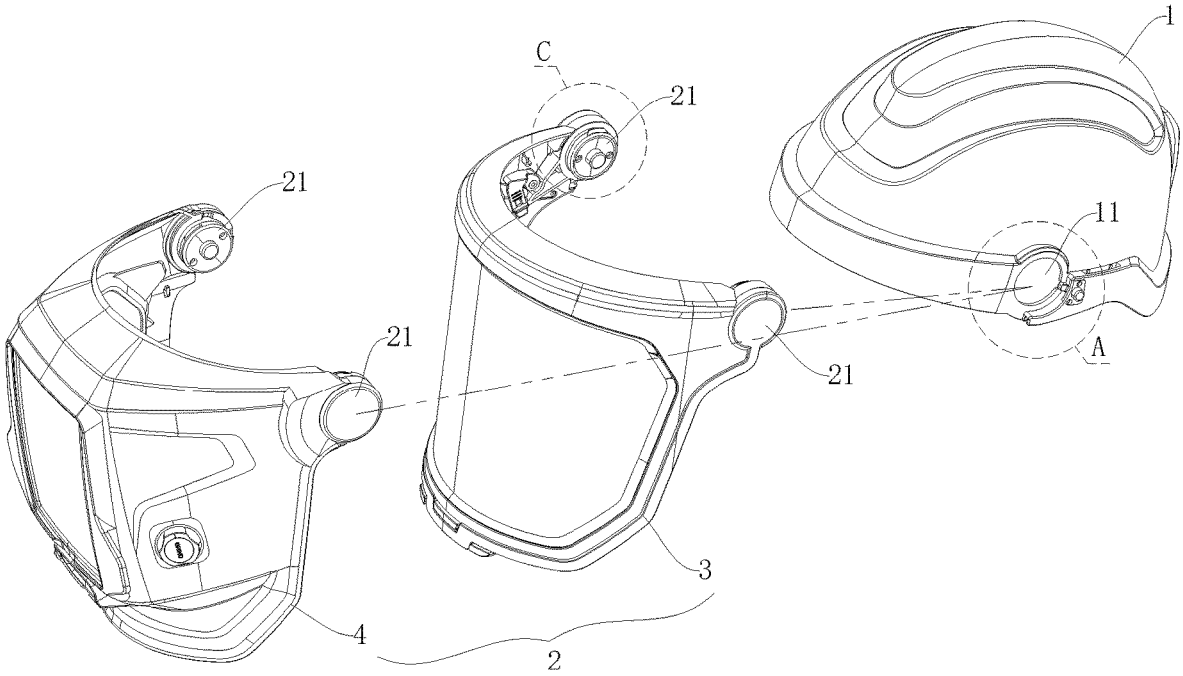
FIG. 1 is a schematic exploded structural view of the connection of two types of quick-release adapter assemblies in the wearable head-protecting safety device according to an embodiment of the present invention.
Figure 2:
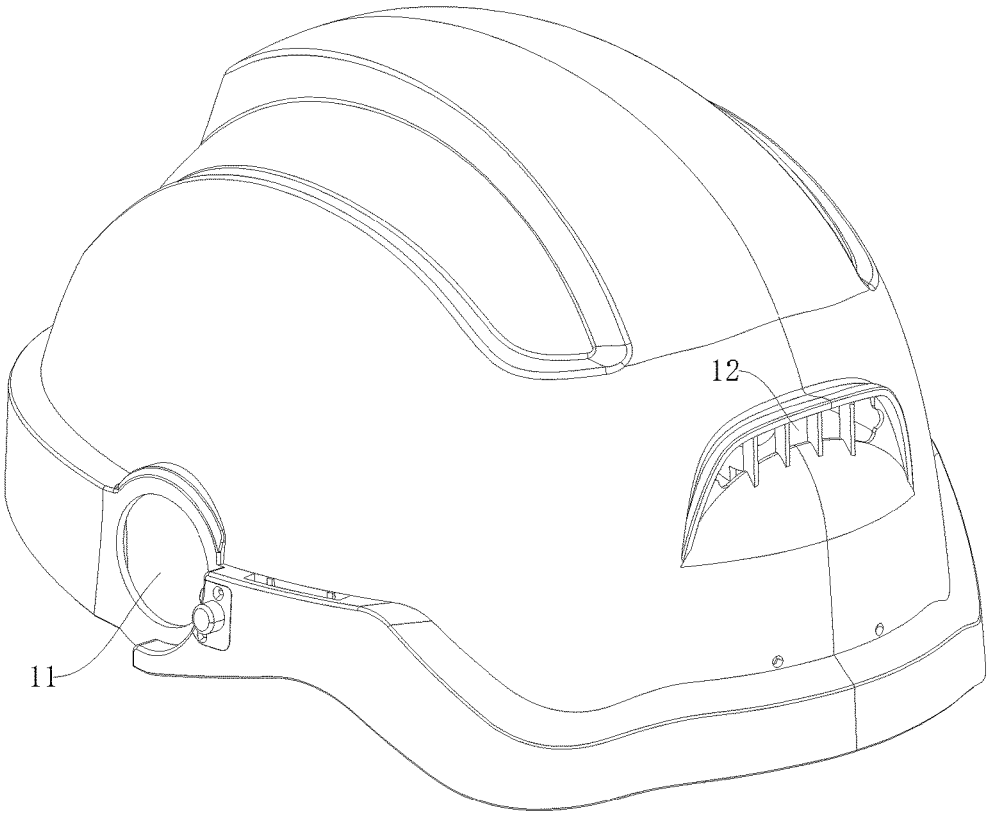
FIG. 2 is a schematic structural diagram of the helmet body according to an embodiment of the present invention.

FIGS. 1-17 illustrate a wearable head-protecting safety device comprising a helmet body 1 provided with oppositely arranged mounting seats 11 on both sides near the lower edge thereof and a quick-release adapter assembly 2 in form of a mask structure, as shown in FIGS. 1 and 2, wherein the quick-release adapter assembly 2 is provided with a quick-release mechanism 21 cooperating with the mounting seat 11 at both ends near the upper edge thereof, the quick-release mechanism 21 being relatively rotatable in relation to and detachably connected to the mounting seats 11, and wherein the quick-release adapter assembly is a grinding flip assembly 3 or a welding flip assembly 4. It should be noted that in the embodiment of the present invention, the helmet body 1 is further provided with an adjustable helmet strap and chin strap (not shown), by which the helmet is secured to the head of the operator. In the embodiment of the present invention, the quick-release adapter assembly 2 is a grinding flip assembly 3 or a welding flip assembly 4. The grinding flip assembly 3 here refers to the mask used for grinding operations, and the welding flip assembly 4 refers to the mask used for welding operations. By providing the quick-release mechanism 21 on the quick-release adapter assembly 2, the connection and removal of the different types of masks to and from and the helmet body 1 can be achieved. It should also be noted that in the embodiment of the present invention, the quick-release adapter assembly 2 may be implemented in various forms, such as conventional buckle connection or bolt connection or the connection methods used below. With the above connection methods, it is convenient to connect the quick-release adapter assembly 2 to the helmet body 1, allowing operators to replace different types of masks in different work scenarios without the need to equip a complete set of mask tools for each work scenario. In this way, not only has the applicability of the mask been improved, but production costs have also been saved.

In the above embodiment, it is possible to achieve installation and replacement of quick-release adapter assembly 2 by providing the mounting seats 11 on the helmet body 1, and switching of various types of masks through the quick-release adapter assembly 2 detachably connected to the helmet body 1. Compared with prior art, the present invention can be applied to various scenarios through mask switching, improving the applicability of the wearable head-protecting safety device.

Figure 3:
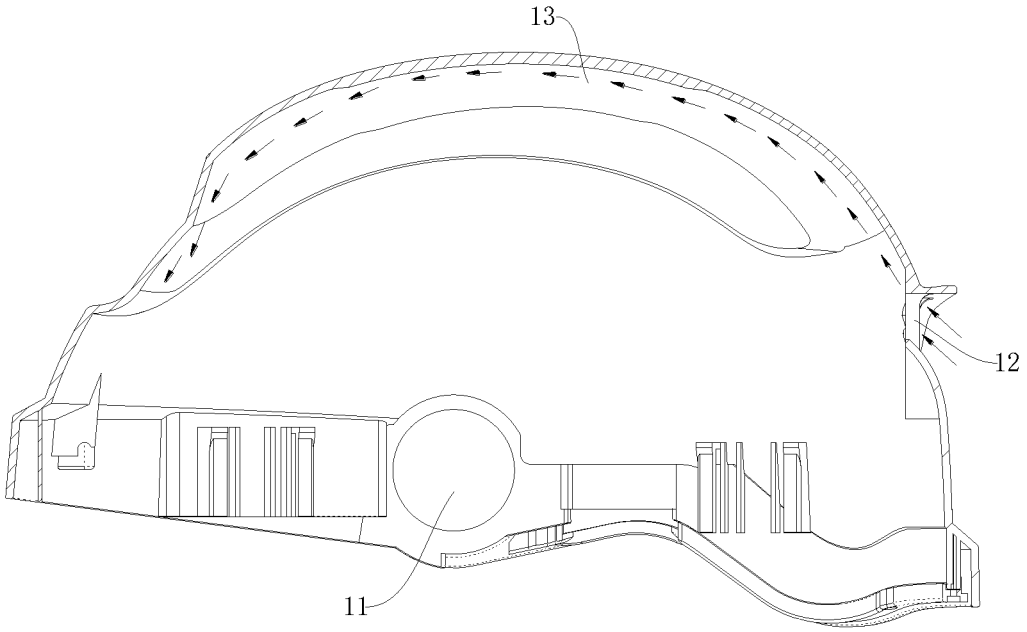
FIG. 3 is a sectional view of the helmet body according to an embodiment of the present invention.

On the basis of the above embodiment, the structure of the helmet body 1 is further improved in the embodiment of the present invention. As shown in FIGS. 2-3, the helmet body 1 is provided with an air inlet 12 at the rear end thereof, and an air guide groove 13 extending from the air inlet 12 to the front end thereof on top of the inner wall of the helmet. As shown in FIG. 2, the air guide groove 13 here may protrude the middle part of the helmet upwards to form an air circulation channel, which realizes the function of heat dissipation above the head when the helmet is used alone.

Figure 4:
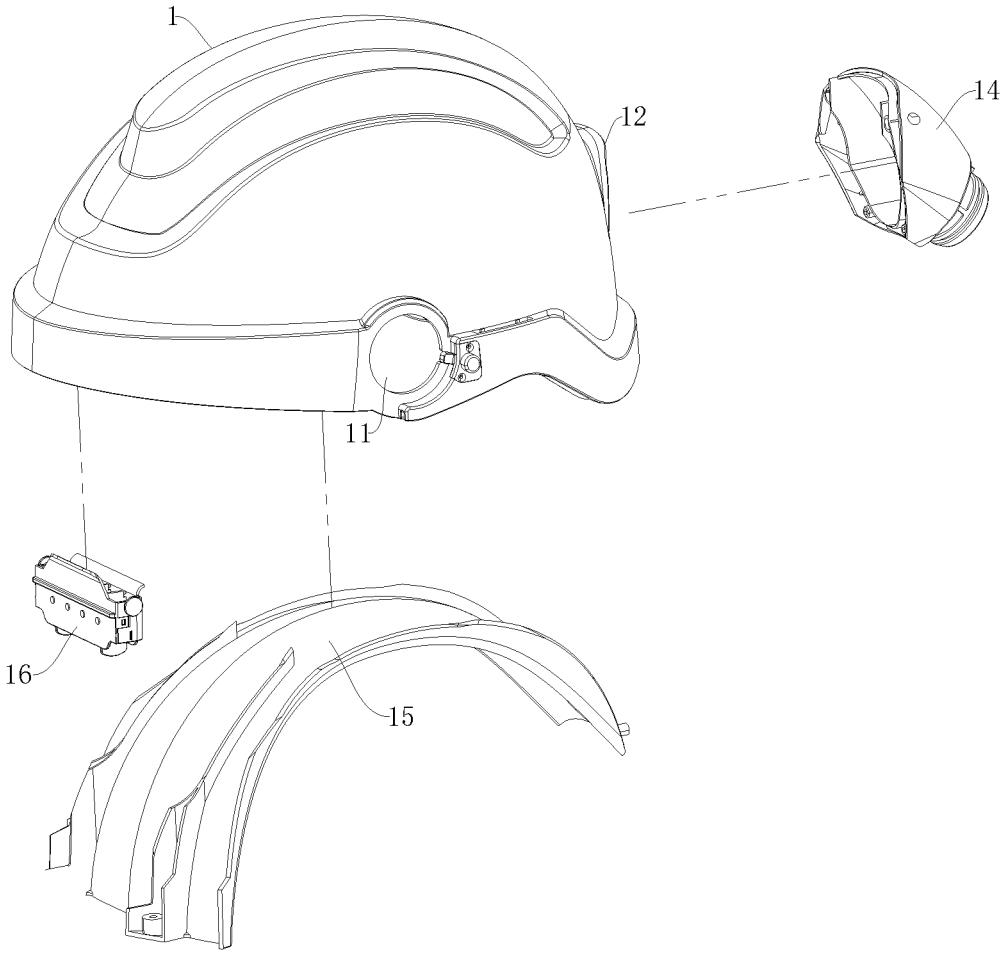
FIG. 4 is a schematic exploded structural view of the helmet body according to an embodiment of the present invention.
Figure 5:
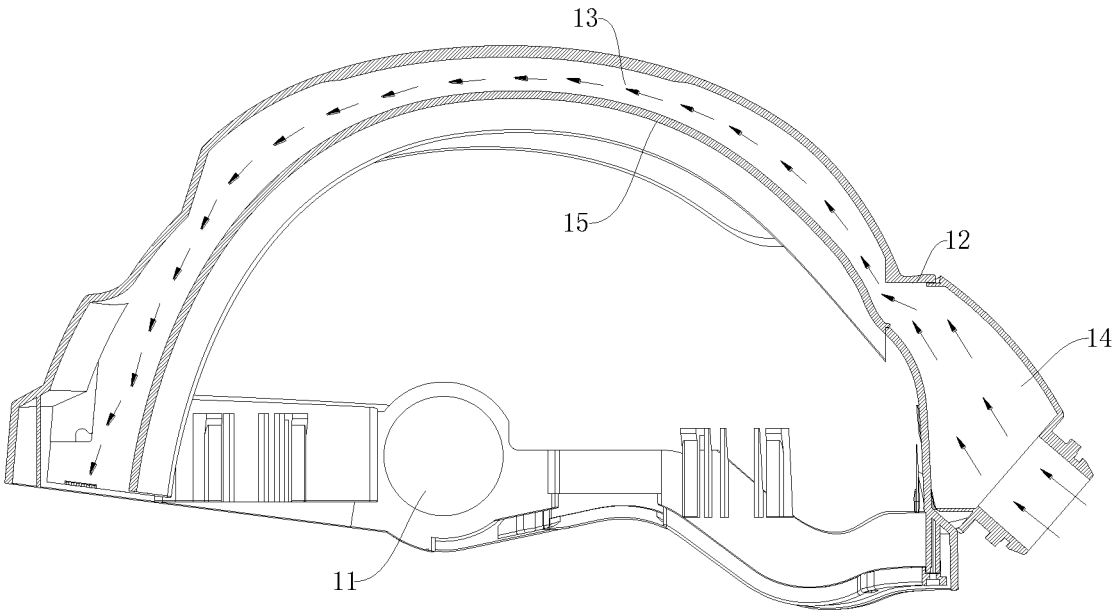
FIG. 5 is a schematic structural diagram of the helmet body forming the air supply channel according to an embodiment of the present invention.

On the basis of the above embodiment, an air supply function is further provided on the basis of the above-mentioned air guide groove 13. As shown in FIGS. 4-5, an air supply connector 14 is connected to the air inlet 12, and an air guide plate 15 is connected to the inner wall of the helmet body 1. The air guide plate 15 cooperates with the air guide groove 13 to form an air supply channel in communication with the air supply connector 14. As shown in FIG. 5, through the arrangement of the air supply connector 14 and the air guide plate 15, a channel for air flow, that is, an air supply channel, is formed on the top of the helmet. In use, the air supply channel is connected to the air supply mechanism through a connecting hose to realize automatic air supply, thus ensuring the safety of operators in the working environment.

Figure 6:
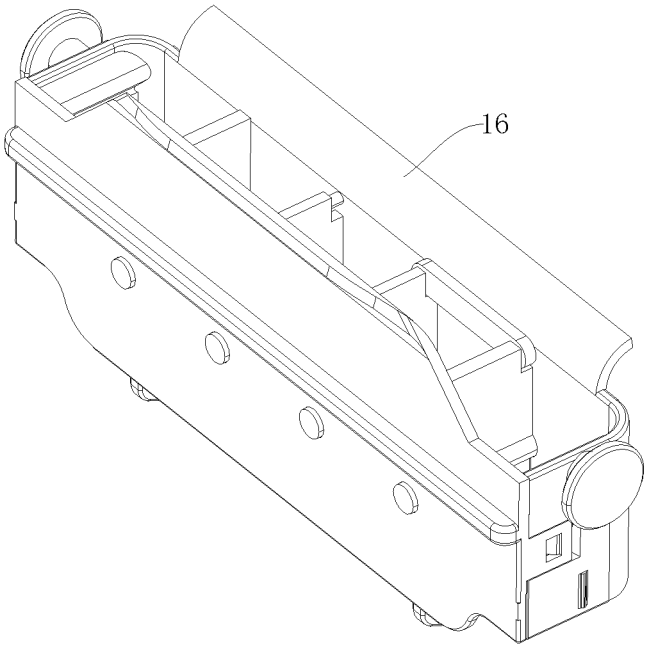
FIG. 6 is a schematic structural diagram of the air direction regulator according to an embodiment of the present invention.
Figure 7:
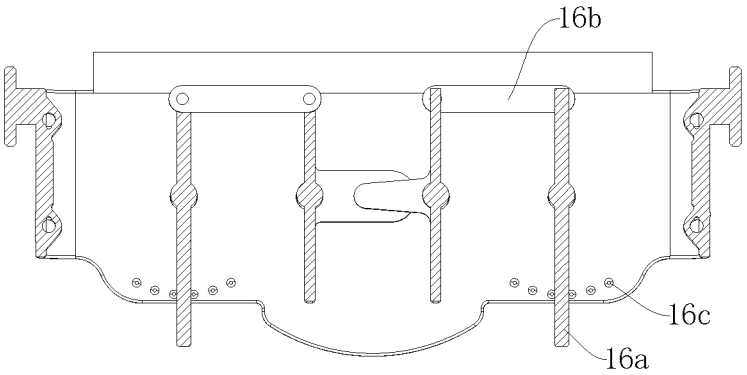
FIG. 7 is a sectional view of the air direction regulator according to an embodiment of the present invention.

In the embodiment of the present invention, in order to improve the comfort of operators, an air direction adjustment function is also provided for specific operations. With reference to FIGS. 4, 6 and 7, the front end of the inner wall of the helmet body 1 is provided with an air direction regulator 16 in communication with the air supply channel. The air direction regulator 16 includes a plurality of air guides 16*a* that are pivotally connected through links 16*b* such that they can rotate relative to each other. The inner wall of the air direction regulator 16 is provided with a positioning member 16*c* connected to the air guides 16*a* in a clearance fit. Specifically, as shown in FIGS. 6-7, the housing of the air direction regulator 16 is a rectangular tubular structure, and the middle part of the air guide 16*a* is rotatably connected in the air direction regulator 16. In this way, the direction of the air guide 16*a* can be changed by turning the air guide 16*a*. With the rotational connection through multiple links 16*b*, the linkage between the multiple air guides 16*a* can be realized. As shown in FIG. 7, the upper links 16*b* can realize the deflection of adjacent air guides 16*a* in the same direction, while the middle links 16*b* can realize the deflection of two adjacent air guides 16*a* in opposite directions. In the embodiment of the present invention, the positioning member 16*c* is a structure with certain elasticity and in contact with the side wall of the air guide 16*a*. In this way, as shown in FIG. 7, the deflection angle of the air guide 16*a* can be positioned thanks to the provision of the multiple positioning members 16*c*, thereby achieving direct or side blowing.

Figure 8:
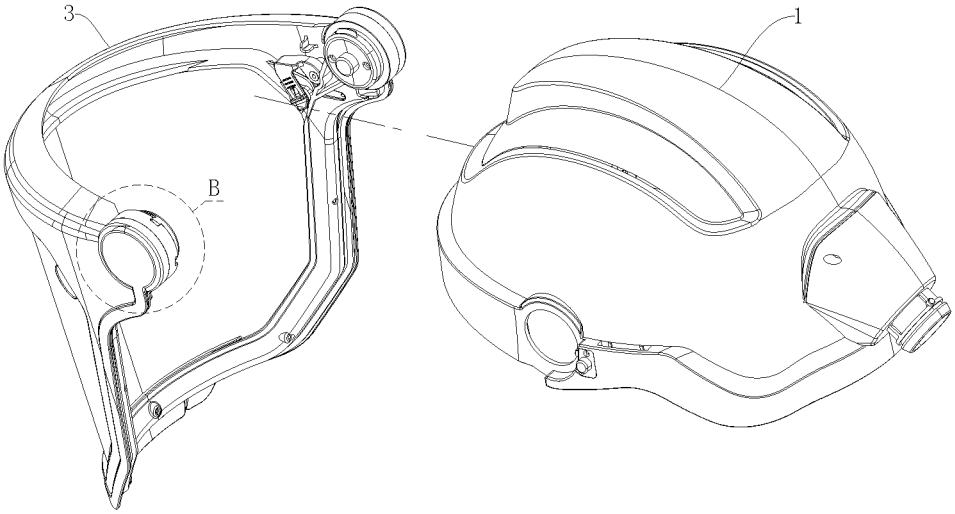
FIG. 8 is a schematic diagram of the installation structure of the grinding flip assembly according to an embodiment of the present invention.
Figure 9:
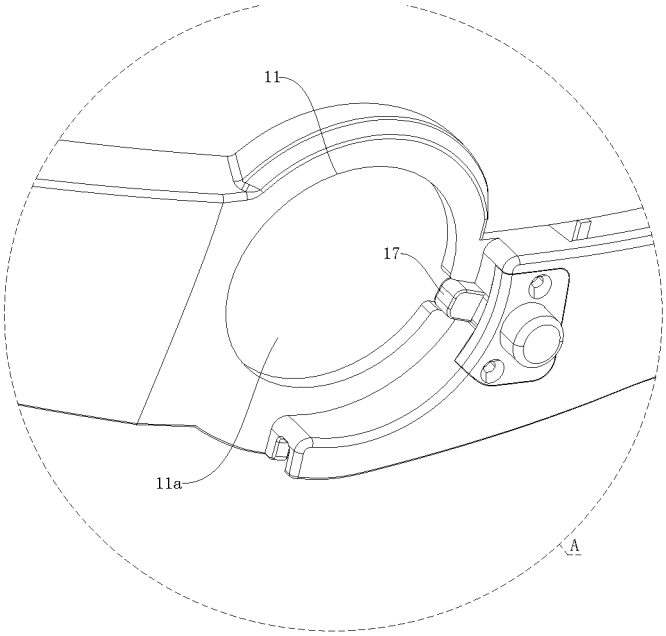
FIG. 9 is a partially enlarged view at A in FIG. 1.
Figure 10:
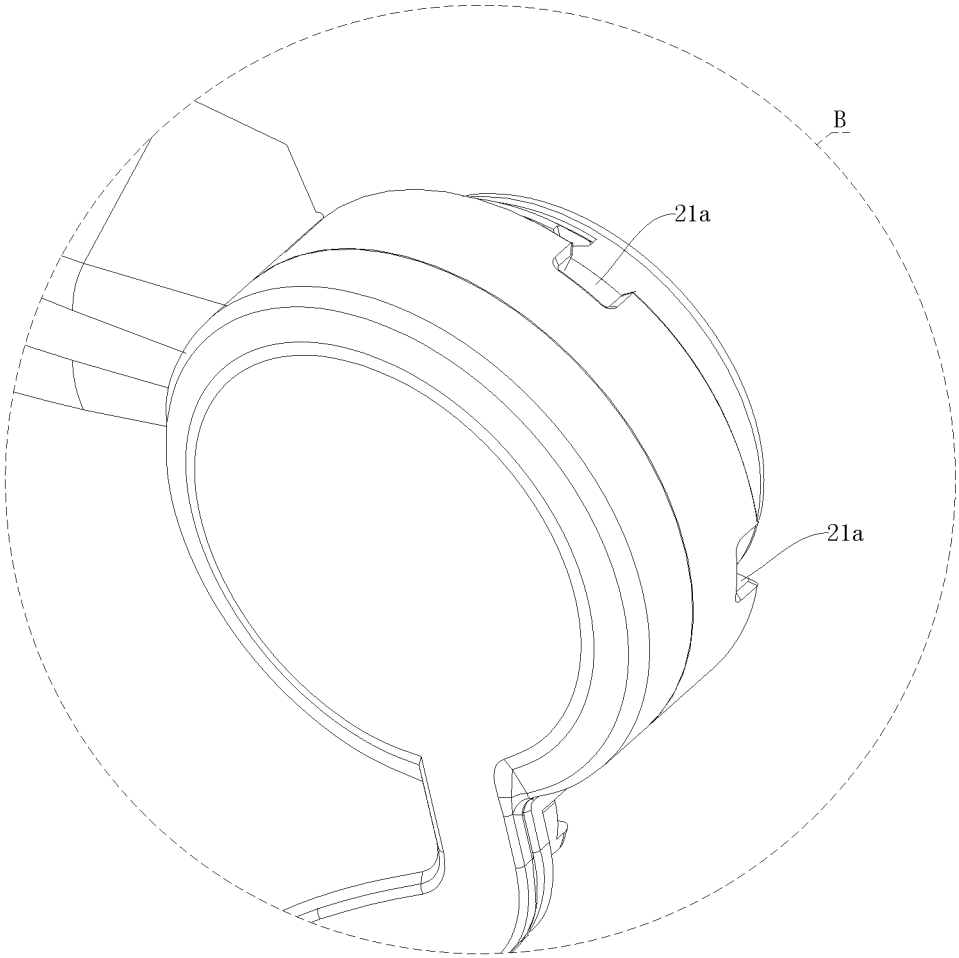
FIG. 10 is a partially enlarged view at B in FIG. 8.
Figure 11:
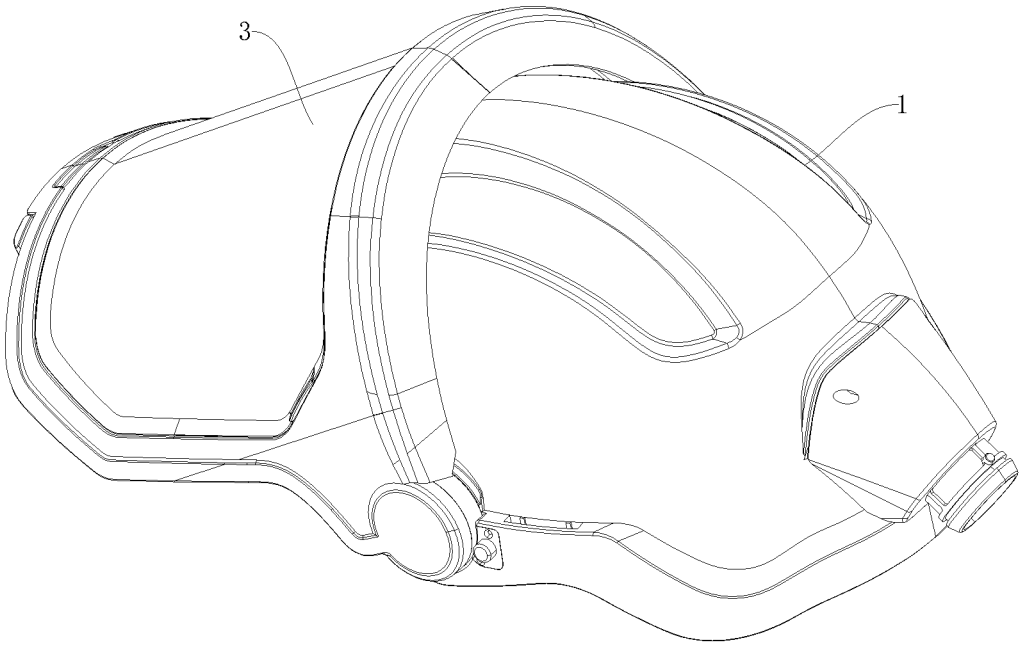
FIG. 11 is a schematic structural diagram of the grinding flip assembly when flipped up according to an embodiment of the present invention.
Figure 15:
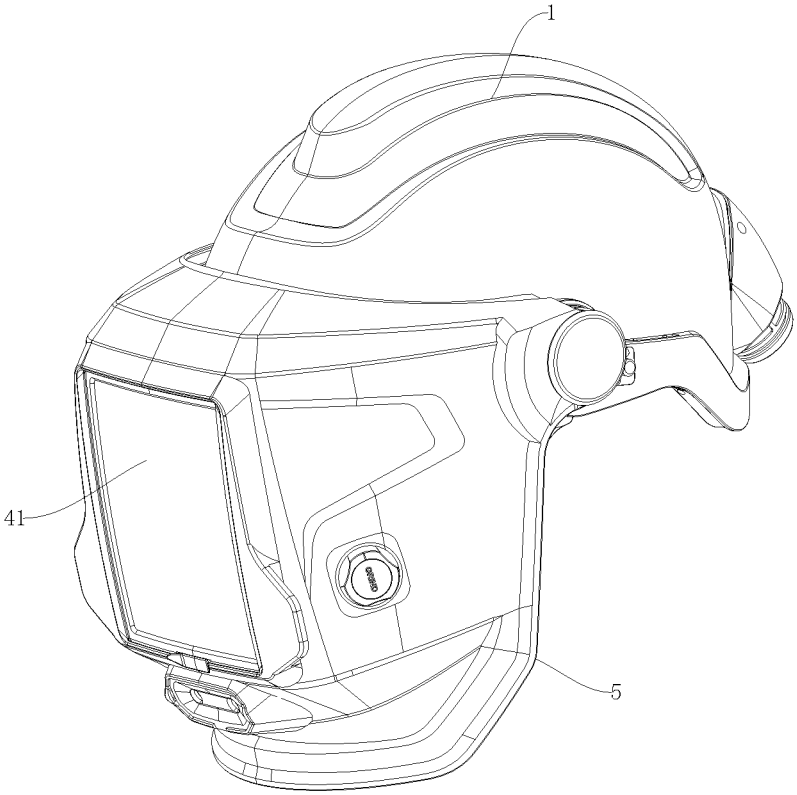
FIG. 15 is a schematic structural diagram of the welding mask according to an embodiment of the present invention.
Figure 16:
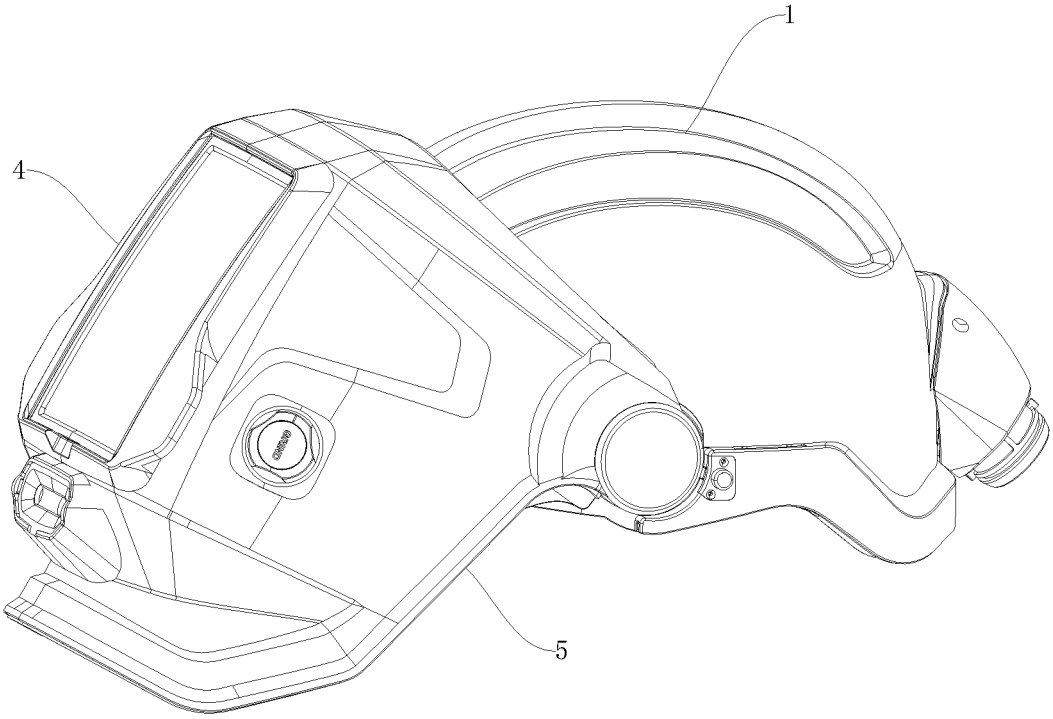
FIG. 16 is a schematic structural diagram of the welding mask when flipped up according to an embodiment of the present invention.

In the embodiment of the present invention, the quick-release adapter assembly 2 is rotatably connected on the mounting seat 11, with the purpose of adapting to the needs of the operator, that is, to rotate the face shield to a low position during operation. As shown in FIGS. 8 and 15, the face shield is rotated to a low position for operation, thereby protecting the operator's face and eyes. When the operator needs to engage in non-operational activities such as communicating with others, eating and drinking for a short period of time, or answering phone calls, the operator needs to rotate the face shield to a high position to open it, as shown in FIGS. 11 and 16. In order to achieve fixation in the low and high positions mentioned above, in the embodiments of the present invention, a locking mechanism is also provided. Specifically, as shown in FIGS. 9 and 10, an end face of the mounting seat 11 is provided with an elastically connected locking member 17, and the quick-release mechanism 21 is provided with at least two locking grooves 21*a* corresponding to the locking member 17. The locking member 17 is configured to extend into the locking groove 21*a* when the locking groove 21*a* on the quick-release mechanism rotates to the position of the locking member 17, whereby the quick-release adapter assembly 2 can be locked when opened and closed. It should be noted that in the embodiment of the present invention, the locking member 17 may be implemented in various structural forms. The lifting and lowering of the locking element 17 may be achieved through a button and a built-in spring as shown in FIG. 9, or through a slope structure. With such arrangement, as shown in FIG. 10, the face shield is in the low position when the locking member 17 is locked into a first locking groove 21*a*, while the face shield is in the high position when the locking member 17 is locked into a second locking groove 21*a*. In this way, the operator's hand which is otherwise required to hold the face shield is freed, improving convenience of use.

Figure 12:
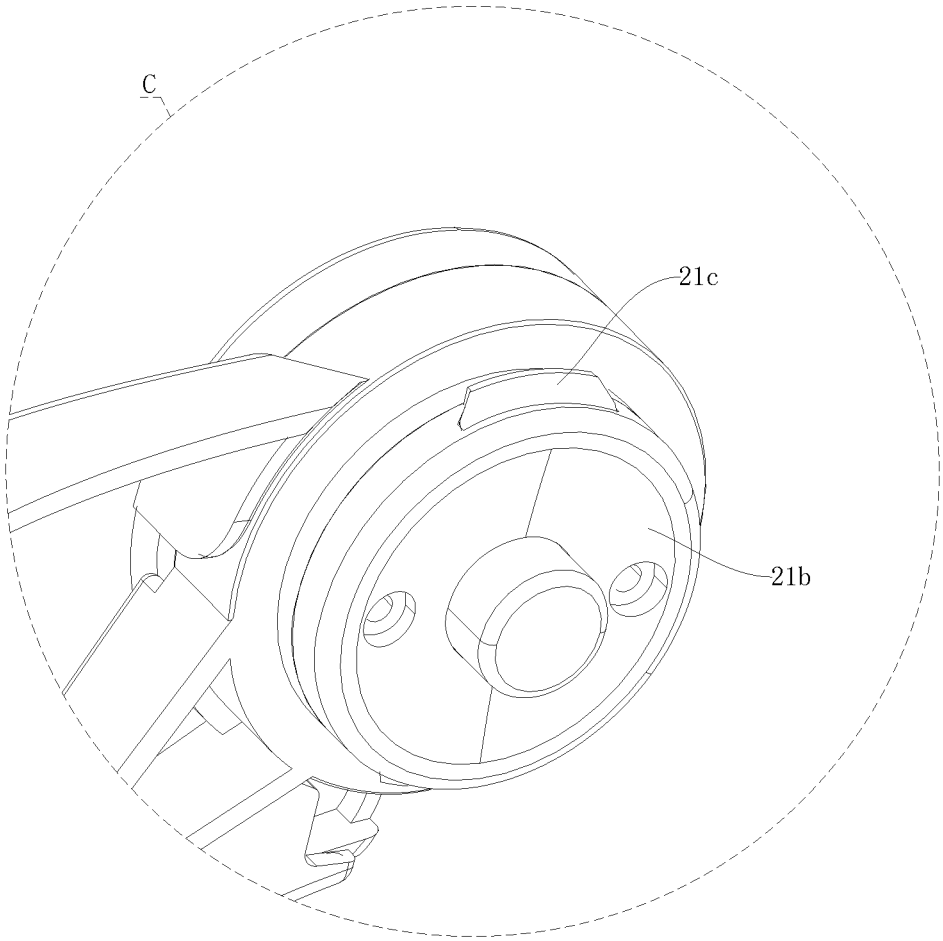
FIG. 12 is a partially enlarged view at C in FIG. 1.

The specific structure of the quick-release mechanism 21 in some embodiments of the present invention is shown in FIGS. 9 and 12. Specifically, the mounting seat 11 is provided with a mounting hole 11*a* and the quick-release mechanism 21 is provided with a connecting column 21*b* cooperating with the mounting hole. The connecting column 21*b* is radially provided with a telescopic stopper 21*c*. The distance between two ends of the stopper 21*c* is greater than the diameter of the mounting hole 11*a* when the stopper extends, and the stopper 21*c* is disposed at a position where the connecting column 21*b* protrudes from the mounting hole 11*a*. As shown in FIG. 12, the stopper 21*c* retracts during the process of inserting the connecting column 21*b* into the mounting hole 11*a*, so that the connecting column 21*b* can pass through the mounting hole 11*a* smoothly. When the stopper 21*c* reaches the other side of the mounting 11*a*, it extends because there is no external force constraint, thereby preventing the connecting column 21*b* from falling off. Since the stopper 21*c* extends and retracts in the radial direction, it does not affect the overall rotation of the quick-release mechanism 21. In this way, through the cooperation of the quick-release mechanism 21 and the locking mechanism, the quick-release adapter assembly 2 can be quickly mounted and removed, and at the same time, it is possible to position the face shield when it is opened and closed after installation of the quick-release adapter assembly 2, facilitating operation and use.

Figure 13:
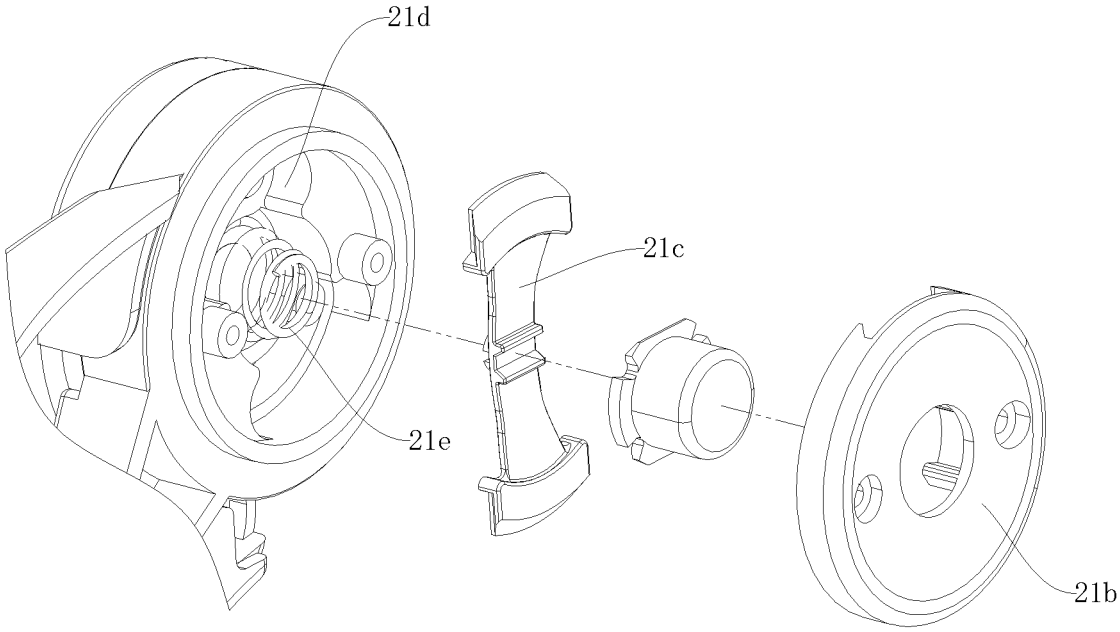
FIG. 13 is a schematic exploded view of the quick-release mechanism according to an embodiment of the present invention.

The specific structure of the quick-release mechanism 21 is shown in some embodiments of the present invention is shown in FIG. 13. Specifically, the quick-release mechanism 21 is provided with a hollow cavity 21*d* having an elastic member 21*e* therein. The stopper 21*c* is in form of a bendable plate-shaped structure and is configured to bend when subjected to external forces along the depth direction of the hollow cavity 21*d*, causing both ends to retract towards the center of the connecting column 21*b*, and to restore deformation under the force of the elastic member 21*e* when the external force disappears. Continuing with reference to FIG. 13, in the embodiment of the present invention, due to the provision of the hollow cavity 21*d* in the quick release mechanism 21, the plate-shaped stopper 21*c* is in contact with a spring in the middle. When the stopper 21*c* is subjected to pressure towards the spring, the middle part of the stopper 21*c* will compress towards the spring. At this time, the ends of the stopper 21*c* extending from both sides of the connecting column 21*b* will retract inward. When the ends of the stopper 21*c* are retracted to be flush with the outer wall of the connecting column 21*b*, the entire quick-release adapter assembly 2 can be easily removed from the mounting hole 11*a*. Of course, it should be noted that in the embodiment of the present invention, the structure for applying force to the stopper 21*c* may be a button as shown in FIG. 13, or a raised structure integrally formed on the stop structure. With such arrangement, the present invention is not only easy to operate, but also has a simple structure, which is convenient for machining and manufacturing.

Figure 14:
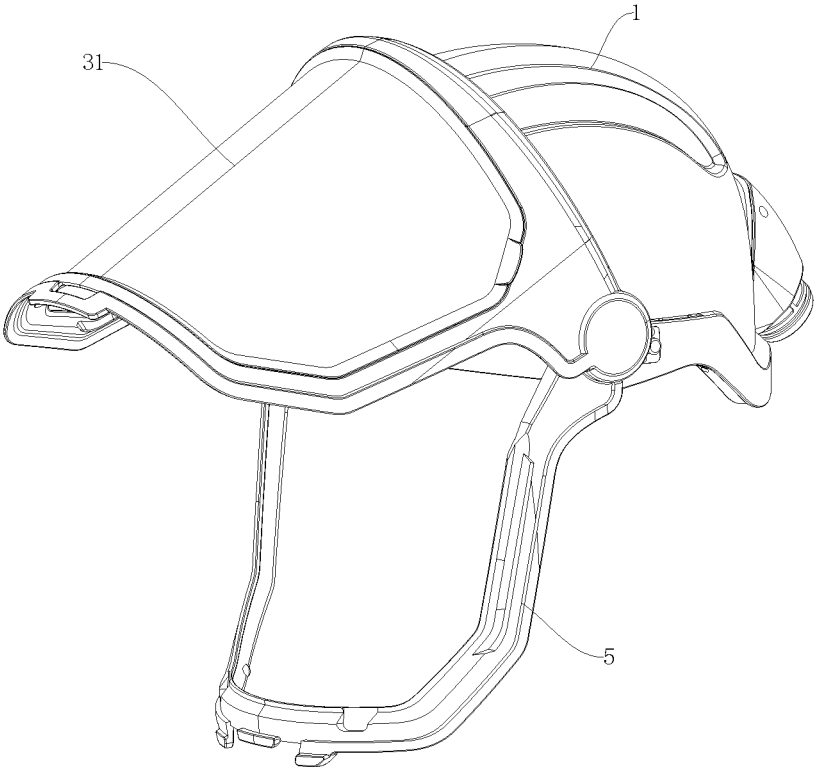
FIG. 14 is a schematic structural diagram of the grinding mask when flipped up according to an embodiment of the present invention.

As shown in FIG. 14, in the embodiment of the present invention, the grinding flip assembly 3 comprises a grinding mask 31 connected to the quick-release mechanism 21. In the embodiment of the present invention, the grinding mask 31 is provided with a transparent protective sheet to protect the face of the operator. The state when the grinding mask 31 is closed is shown in FIG. 8, and the state when the grinding mask 31 is open is shown in FIG. 11.

As shown in FIG. 15, in the embodiment of the present invention, the welding flip assembly 4 comprises a welding mask 41 connected to the quick-release mechanism 21. In the embodiment of the present invention, the welding mask 41 is provided with an automatic darkening filter to provide automatic protection for users during operation. The state when the welding mask 41 is closed is shown in FIG. 15, and the state when the welding mask 41 is open is shown in FIG. 16.

Figure 17:
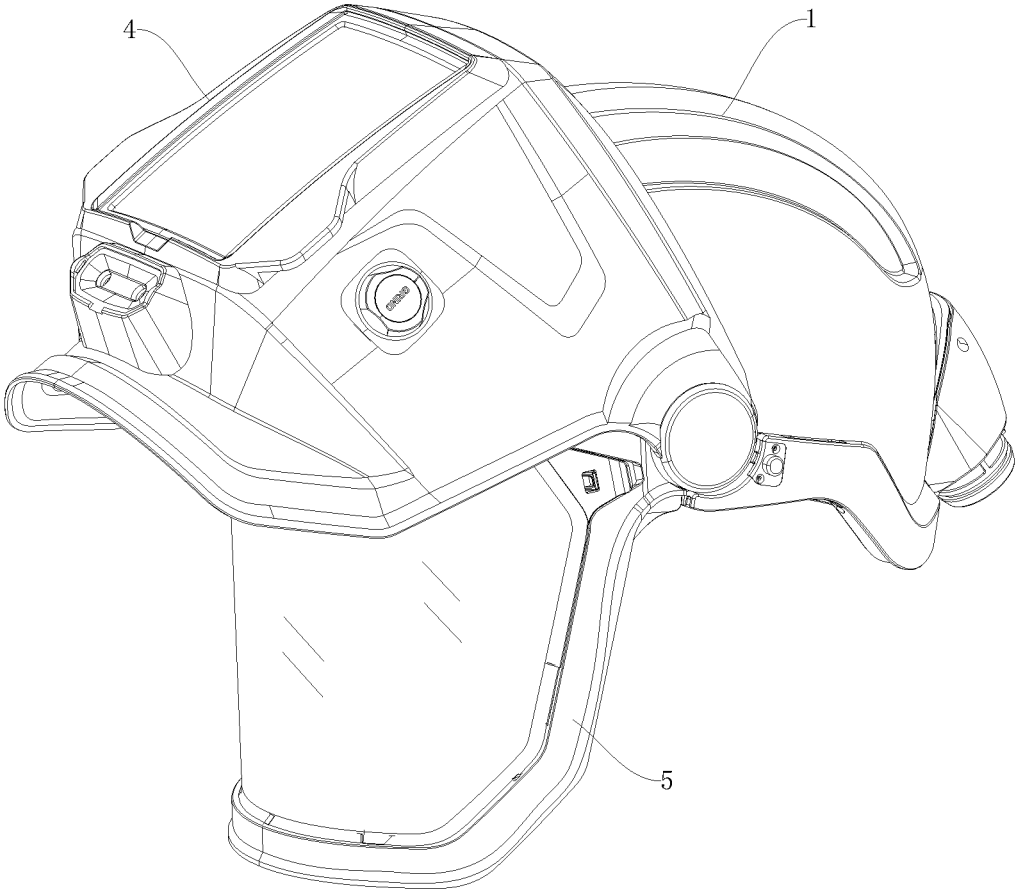
FIG. 17 is a schematic structural diagram of the lower support bracket and the welding mask integrated together according to an embodiment of the present invention.

On the basis of the above embodiments, as shown in FIGS. 14 and 17, in the embodiment of the present invention, the wearable head-protecting safety device further comprises a lower support bracket 5 in form of a frame structure. On one hand, the lower support bracket 5 serves to support the grinding mask 31 and the welding mask 41 to improve the stability of the mask. On the other hand, as shown in FIG. 17, when the welding mask 41 is opened, a transparent sheet may be installed on the lower support bracket 5 to provide protection. In this case, welding mask 41 can also be used for grinding, further improving the applicability of the wearable head-protecting safety device. In one embodiment of the present invention, the lower support bracket 5 is integrated on the quick-release adapter assembly 2. As shown in FIGS. 14 and 17, the lower support bracket 5 is removed or installed together with the grinding flip assembly 3 or the welding flip assembly 4, which can improve the overall structural strength.

Embodiment 2

Figure 18:
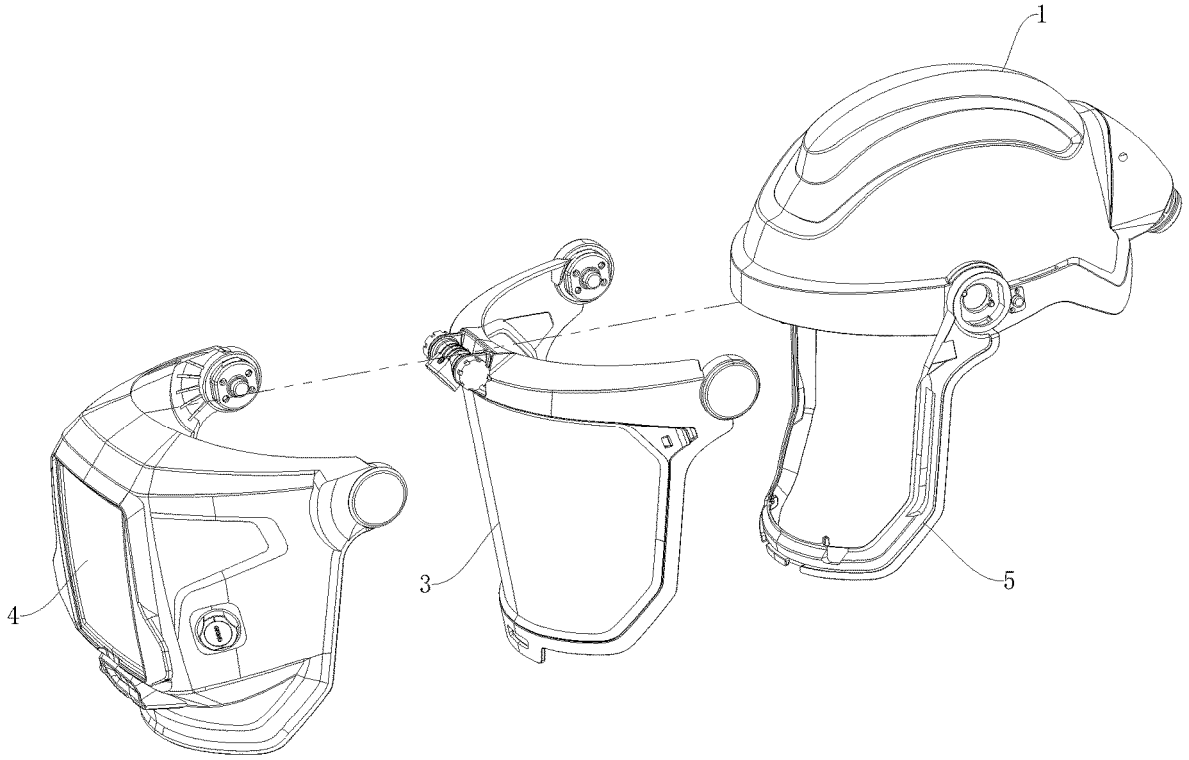
FIG. 18 is a schematic structural diagram of the lower support bracket separately connected to the helmet body according to another embodiment of the present invention.

In the second embodiment of the present invention, as shown in FIG. 18, the installation form of the lower support bracket 5 has been improved. In order to reduce the number of lower support brackets 5, the grinding flip assembly 3 and the welding flip assembly 4 share the lower support bracket 5, that is, the lower bracket 5 is independently connected to the helmet body 1 in a relatively rotatable manner. Continuing with reference to FIG. 18, the mounting end of the lower support bracket 5 is connected to the locking mechanism to achieve position fixation at different angles. A mounting hole 11*a* is provided at the installation location of the lower support bracket 5. The quick-release mechanism 21 on the grinding flip assembly 3 and the welding flip assembly 4 is quickly removed and connected through the mounting hole 11*a* provided on the lower support bracket 5. With such arrangement, the overall weight of the grinding flip assembly 3 and the welding flip assembly 4 has been reduced. Moreover, when the wearable head-protecting safety device is equipped with the lower support bracket 5 alone, a head cover type dust cover can also be installed on the helmet body 1, in which case the lower support bracket 5 acts as a support, further increasing the applicability of the wearable head-protecting safety device.

Those skilled in the industry should understand that the present invention is not limited by the foregoing embodiments. The foregoing embodiments and descriptions only illustrate the principles of the present invention. Without departing from the spirit and scope of the present invention, the present invention will have various changes and improvements, which fall within the scope of the claimed invention. The scope of protection claimed by the present invention is defined by the appended claims and their equivalents.

The invention claimed is:

1. A wearable head-protecting safety device, comprising a helmet body provided with oppositely arranged mounting seats on both sides near a lower edge thereof and a quick-release adapter assembly in form of a mask structure, wherein the quick-release adapter assembly is provided with a quick-release mechanism cooperating with the mounting seat at both ends near an upper edge thereof, the quick-release mechanism being relatively rotatable and detachably connected to the mounting seats;

wherein the quick release adapter assembly is a grinding flip assembly or a welding flip assembly; and wherein the helmet body is provided with an air inlet at the rear end thereof, and an air guide groove extending from the air inlet to a front end thereof on top of an inner wall of the helmet.

2. The wearable head-protecting safety device according to claim 1, wherein an air supply connector is connected to the air inlet, and an air guide plate is connected to the inner wall of the helmet body, the air guide plate cooperating with the air guide groove to form an air supply channel in communication with the air supply connector.

3. The wearable head-protecting safety device according to claim 2, wherein a front end of the inner wall of the helmet body is provided with an air direction regulator in communication with the air supply channel, the air direction regulator including a plurality of air guides that are pivotally connected through links such that they can rotate relative to each other, and wherein the inner wall of the air direction regulator is provided with a positioning member connected to the air guides in a clearance fit.

4. The wearable head-protecting safety device according to claim 1, wherein an end face of the mounting seat is provided with an elastically connected locking member, and the quick-release mechanism is provided with at least two locking grooves corresponding to the locking member, the locking member being configured to extend into the locking groove when the locking groove on the quick-release mechanism rotates to the position of the locking member, whereby the quick-release adapter assembly can be locked when opened and closed.

5. The wearable head-protecting safety device according to claim 1, wherein the mounting seat is provided with a mounting hole and the quick-release mechanism is provided with a connecting column cooperating with the mounting hole, the connecting column being radially provided with a telescopic stopper, wherein the distance between two ends of the stopper is greater than a diameter of the mounting hole when the stopper extends, and wherein the stopper is disposed at a position where the connecting column protrudes from the mounting hole.

6. The wearable head-protecting safety device according to claim 5, wherein the quick-release mechanism is provided with a hollow cavity having an elastic member therein, and wherein the stopper is in form of a bendable plate-shaped structure and is configured to bend when subjected to external force along the depth direction of the hollow cavity, causing both ends to retract towards the center of the connecting column, and to restore deformation under the force of the elastic member when the external force disappears.

7. The wearable head-protecting safety device according to claim 1, wherein the grinding flip assembly comprises a grinding mask connected to the quick-release mechanism.

8. The wearable head-protecting safety device according to claim 1, wherein the welding flip assembly comprises a welding mask connected to the quick-release mechanism.

9. The wearable head-protecting safety device according to claim 1, further comprising a lower support bracket in form of a frame structure, the lower support bracket being integrated into the quick-release adapter assembly or independently connected to the helmet body in a relatively rotatable manner.

* * * * *